US008353355B2

(12) United States Patent
Smith et al.

(10) Patent No.: US 8,353,355 B2
(45) Date of Patent: Jan. 15, 2013

(54) DRILL STRING/ANNULUS SEALING WITH SWELLABLE MATERIALS

(75) Inventors: Lee M. Smith, Anchorage, AK (US); Alan B. Webb, Burleson, TX (US); Vijay Karode, Carrollton, TX (US); Karl M. Tunstall, Highlands Ranch, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 226 days.

(21) Appl. No.: 12/833,393

(22) Filed: Jul. 9, 2010

(65) Prior Publication Data

US 2012/0006569 A1 Jan. 12, 2012

(51) Int. Cl.
*E21B 33/12* (2006.01)

(52) U.S. Cl. ..... 166/387; 166/386; 166/195; 166/179; 175/231; 175/243

(58) Field of Classification Search ..... 166/387, 166/120, 302, 386, 195, 179; 175/231, 243
See application file for complete search history.

(56) References Cited

U.S. PATENT DOCUMENTS 4,534,426 A * 8/1985 Hooper ..... 175/65
5,701,957 A * 12/1997 Williamson et al. ..... 166/297
2004/0020662 A1 2/2004 Freyer
2008/0029303 A1 2/2008 Codazzi et al.
2009/0139707 A1 6/2009 Berzin et al.
2009/0178800 A1 7/2009 Korte et al.

OTHER PUBLICATIONS

International Search Report with Written Opinion issued Feb. 17, 2012 for International Patent Application No. PCT/US11/040907, 8 pages.
Halliburton, Easywell; Reliable Zonal Isolation; H05794; dated 2009; 6 pages.
Halliburton, Easywell; Swellpacker® Lite II Isolation System; H06917; Dec. 2009; 2 pages.

* cited by examiner

*Primary Examiner* — Cathleen Hutchins
(74) *Attorney, Agent, or Firm* — Smith IP Services, P.C.

(57) ABSTRACT

A well system can include a drill string having a drill bit at an end thereof, and a swellable seal exposed to fluid in an annulus external to the drill string. The swellable seal can include a swellable material which swells in response to the fluid comprising a predetermined activating agent. A method of preventing undesired release of fluid from a wellbore can include displacing a drill string through the wellbore, thereby drilling the wellbore, and installing in the wellbore a swellable seal which, in response to the fluid comprising a predetermined activating agent, reduces flow through an annulus formed radially between the drill string and the wellbore. Another well system can include a swellable seal carried into a wellbore on a drill string, with the swellable seal including a swellable material which swells in response to a fluid in the wellbore comprising a predetermined activating agent.

9 Claims, 4 Drawing Sheets

DRILL STRING/ANNULUS SEALING WITH SWELLABLE MATERIALS

BACKGROUND

This disclosure relates generally to equipment utilized and operations performed in conjunction with a subterranean well and, in an example described below, more particularly provides for sealing off an annulus about a drill string with swellable materials.

In conventional drilling operations, a drilling fluid (also known to those skilled in the art as "mud") is typically chosen to have a density which will prevent an influx of fluid from a formation being drilled. That is, hydrostatic pressure exerted by the drilling fluid is generally greater than pore pressure in the formation.

If, however, fluid from the formation should enter a wellbore, this can in some circumstances lead to an uncontrolled release of fluid from the wellbore. Therefore, it will be appreciated that it would be desirable to prevent, or at least reduce, such uncontrolled release of fluid from a wellbore.

SUMMARY

In the disclosure below, systems and methods are provided which bring improvements to the art of preventing uncontrolled release of fluid from a wellbore. One example is described below in which a swellable seal is used to seal off an annulus about a drill string. Another example is described below in which the swellable seal swells in response to an activating agent being present in the annulus.

In one aspect, the present disclosure provides to the art a well system which can include a drill string having a drill bit at an end thereof. A swellable seal is exposed to fluid in an annulus external to the drill string. The swellable seal includes a swellable material which swells in response to the fluid comprising a predetermined activating agent.

In another aspect, a method of preventing undesired release of fluid from a wellbore is provided. The method can comprise displacing a drill string through the wellbore, thereby drilling the wellbore; and installing in the wellbore a swellable seal which, in response to the fluid comprising a predetermined activating agent, reduces flow through an annulus formed radially between the drill string and the wellbore.

In yet another aspect, a well system can comprise a swellable seal carried into a wellbore on a drill string, with the swellable seal including a swellable material which swells in response to a fluid in the wellbore comprising a predetermined activating agent.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
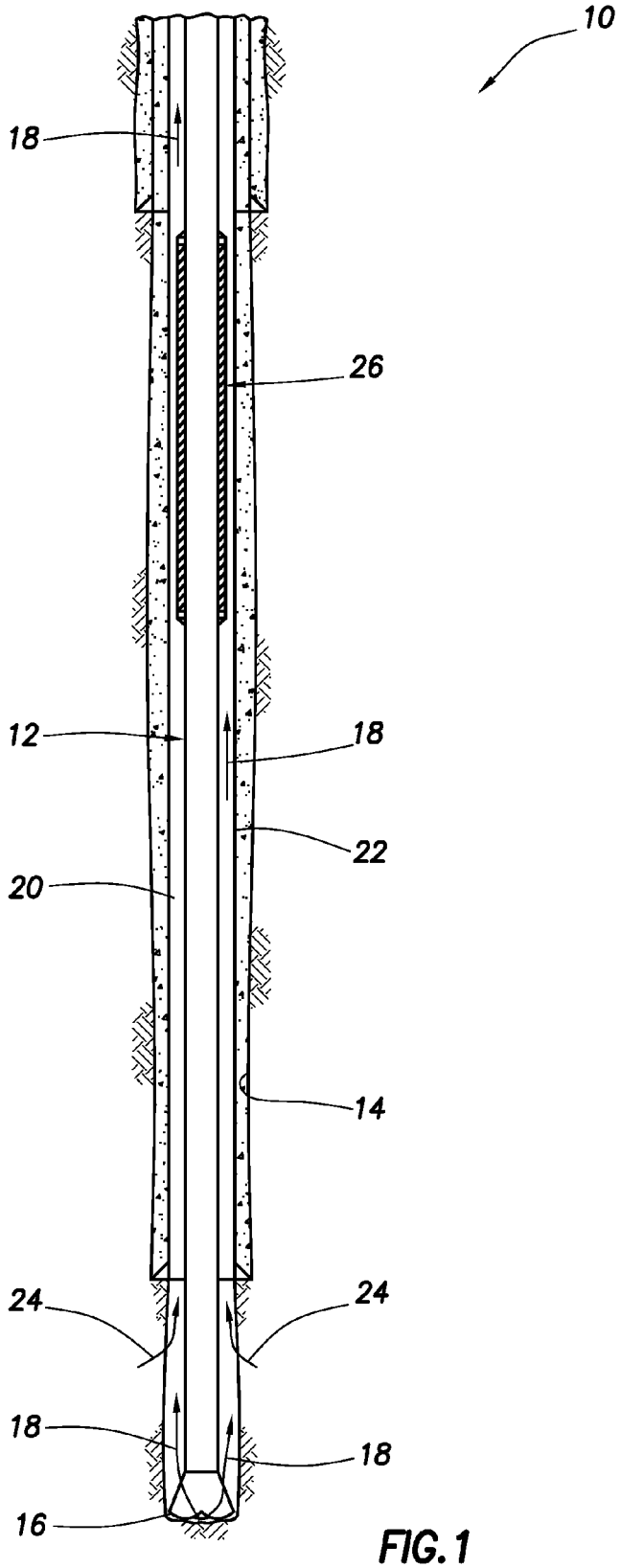
FIG. 1 is a schematic partially cross-sectional view of a well system and associated method which can embody principles of the present disclosure.

Representatively illustrated in FIG. 1 is a well system 10 and associated method which can embody principles of this disclosure. In the well system 10, a drill string 12 is conveyed into a wellbore 14, in order to drill the wellbore further. For this purpose, the drill string 12 includes a drill bit 16 at its distal end.

The drill string 12 could be rotated to thereby rotate the drill bit 16, or a fluid motor (also known as a mud motor, not shown) could rotate the drill bit in response to circulation of fluid 18 through the drill string. In other examples (such as impact drilling, etc.), the drill bit 16 may not be rotated at all.

Note that the fluid 18 circulated through the drill string 12 returns to the surface via an annulus 20 surrounding the drill string. Where the wellbore 14 is protected by a wellbore lining 22 (such as casing, liner, etc.), the annulus 20 extends radially between the drill string 12 and the wellbore lining, but where the wellbore is not lined (e.g., the wellbore is uncased or open hole), the annulus extends radially between the drill string and the wellbore. In either case, the annulus 20 is formed radially between the drill string 12 and the wellbore 14.

At this point it should be clearly understood that the well system 10 depicted in FIG. 1 is merely one example of a wide variety of different well systems which can embody principles of this disclosure. Thus, it will be appreciated that the principles of this disclosure are not limited in any manner to the details of the well system 10 depicted in the drawings or described herein.

Due to various well conditions, it may happen that hydrocarbon fluid 24 (such as gas, oil, etc.) could enter the wellbore 14 and flow through the annulus 20 with the drilling fluid 18 to the surface. This can, in some instances, cause a hazardous situation at the surface, such as an uncontrolled release of hydrocarbons from the well, etc.

In order to prevent this from happening, a swellable seal 26 is exposed to the fluid 18 in the annulus 20. In the example depicted in FIG. 1, the swellable seal 26 is carried on the drill string 12, but in other examples (such as that illustrated in FIG. 3) the swellable seal may not be conveyed into the wellbore 14 on the drill string.

Figure 2:
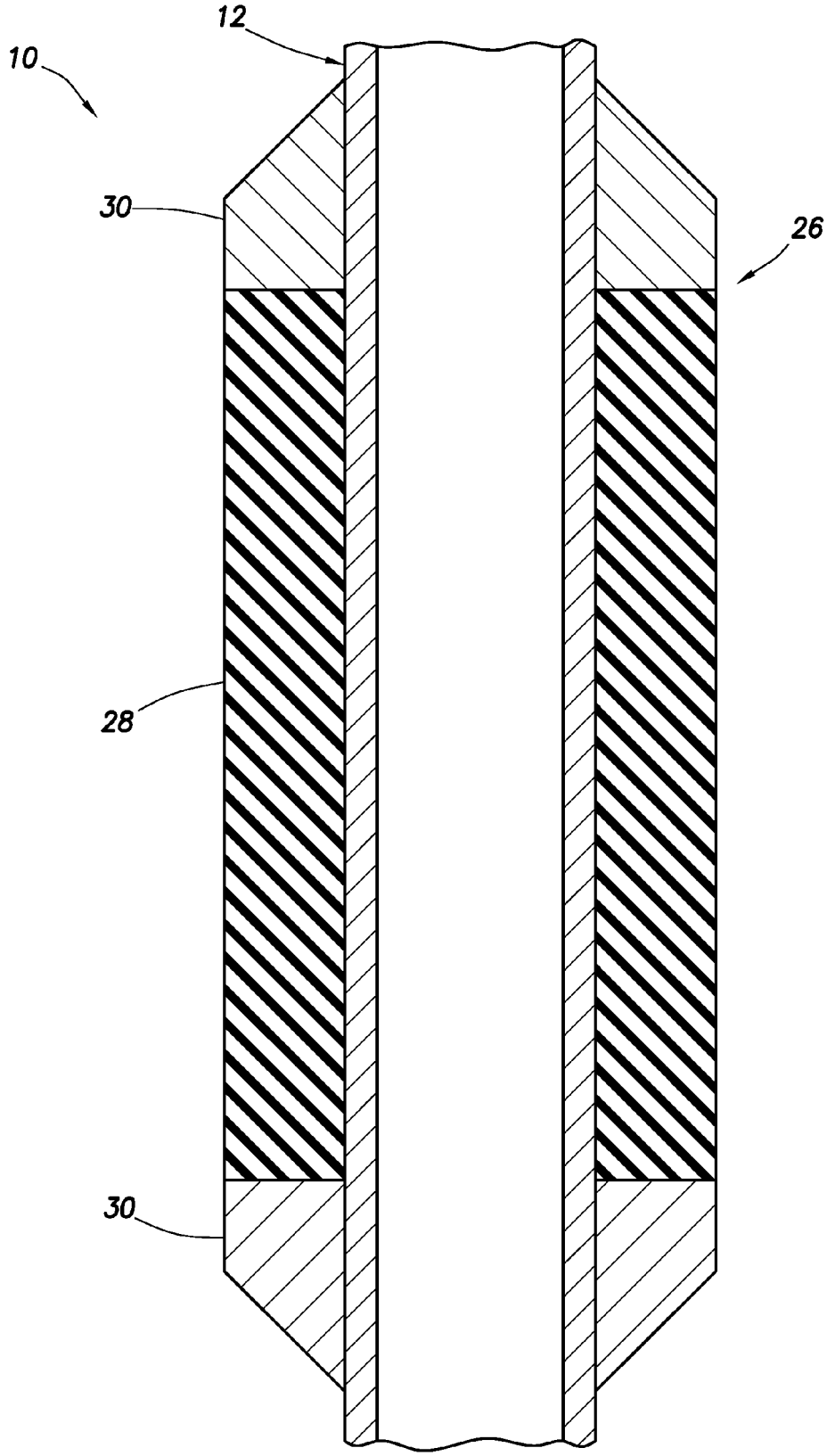
FIG. 2 is an enlarged scale cross-sectional view of a swellable seal which may be used in the well system of FIG. 1.

Referring additionally now to FIG. 2, an enlarged scale cross-sectional view of the swellable seal 26 is representatively illustrated, apart from the remainder of the well system 10. In this view it may be seen that the swellable seal 26 includes a swellable material 28 which encircles the drill string 12 longitudinally between two end rings 30.

Although the swellable seal 26 is depicted in FIG. 2 as having the swellable material 28 on the drill string 12, in other examples the swellable material could be disposed on a purpose-built tubular mandrel which is interconnected as part of the drill string. If the swellable material 28 is installed on drill pipe as it is being conveyed into the wellbore 14, then a longitudinally split swellable material could be used, of the type described in U.S. Publication No. 2008/0078561 (application Ser. No. 11/852295, filed 8 Sep. 2007), the entire disclosure of which is incorporated herein by this reference.

Alternatively, the swellable material 28 could be spirally or helically wrapped on the drill pipe, molded or coated onto a tubular mandrel, and a stack or at least multiple ones of the swellable seal 26 could be disposed on a single drill pipe or mandrel. Thus, it should be appreciated that any configuration of the swellable seal 26, and any manner of attaching the swellable seal to a drill pipe or mandrel, may be used in keeping with the principles of this disclosure.

The swellable material 28 swells when contacted by a predetermined activating agent. The term "swell" and similar terms (such as "swellable") are used herein to indicate an increase in volume of a swellable material.

Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 28 is preferably a hydrocarbon fluid (such as oil or gas). In the well system 10, the swellable material 28 swells when the fluid 18 comprises the activating agent (e.g., when the fluid 24 enters the wellbore 14 from a formation surrounding the wellbore). The swollen material 28 seals off the annulus 20, or at least restricts flow of the fluid 18 through the annulus.

The activating agent which causes swelling of the swellable material 28 could be water and/or hydrocarbon fluid (such as oil or gas). The activating agent could be naturally present in the well, or it could be conveyed with the swellable seal 26, conveyed separately or flowed into contact with the material 28 in the well when desired. Any manner of contacting the activating agent with the material 28 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material 28 may have a substantial portion of cavities therein which are compressed or collapsed at the surface condition. Then, after being placed in the well at a higher pressure, the material 28 is expanded by the cavities filling with fluid.

This type of apparatus and method might be used where it is desired to expand the material 28 in the presence of gas rather than oil or water. A suitable swellable material is described in U.S. Published Application No. 2007-0257405, the entire disclosure of which is incorporated herein by this reference.

Preferably, the swellable material 28 used in the device 36 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined in the swellable seal 26, if desired.

It should, thus, be clearly understood that any swellable material which swells when contacted by a predetermined activating agent may be used in keeping with the principles of this disclosure. The swellable seal 26 could also swell in response to contact with any of multiple activating agents. For example, the swellable seal 26 could swell when contacted by hydrocarbon fluid, or when contacted by water.

Figure 3:
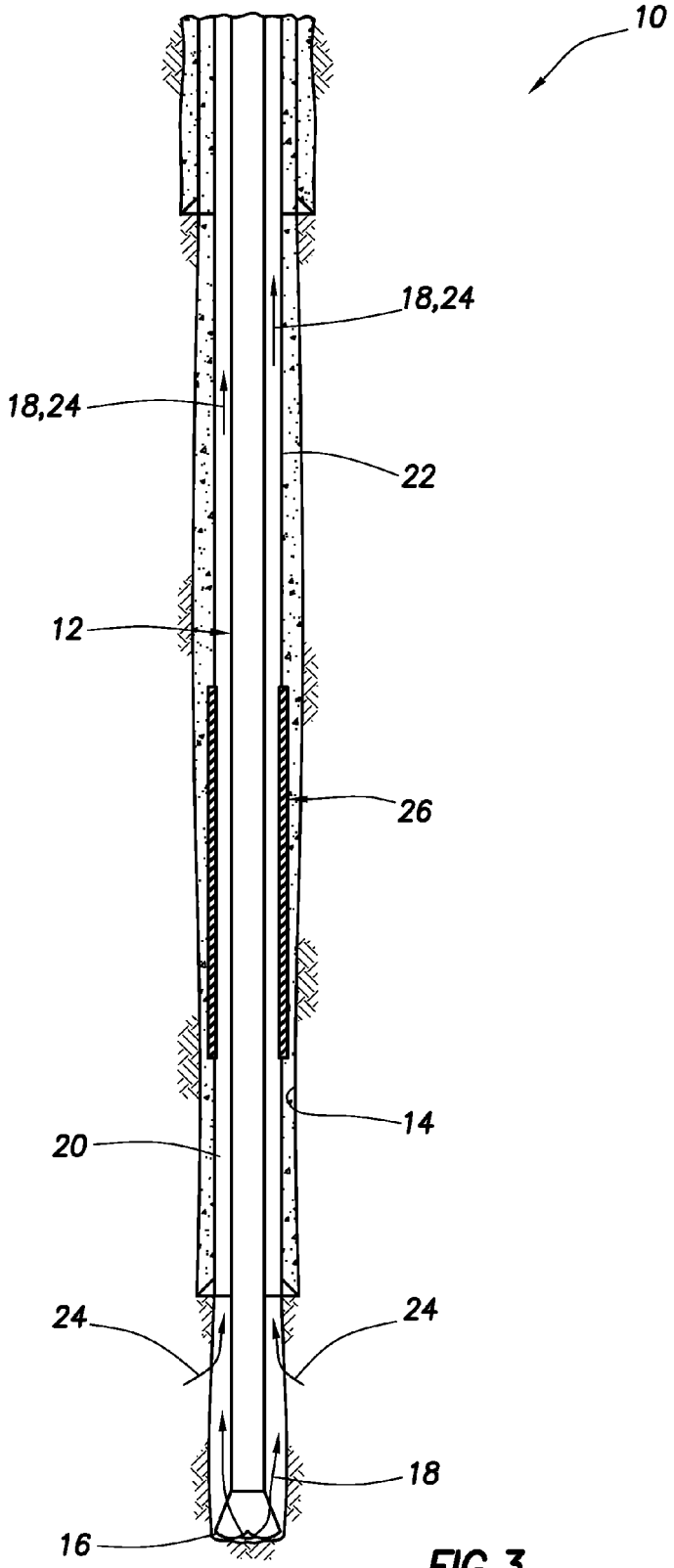
FIG. 3 is a schematic partially cross-sectional view of another configuration of the well system.

Referring additionally now to FIG. 3, another configuration of the well system 10 is representatively illustrated. In this configuration, the swellable seal 26 is carried on the wellbore lining 22, instead of on the drill string 12. Thus, the swellable seal 26 is installed with the wellbore lining 22 when the wellbore lining is installed in the wellbore 14.

The swellable material 28 of the seal 26 swells to seal off, or at least reduce flow through, the annulus 20 in response to the fluid 18 comprising an activating agent (e.g., when the hydrocarbon fluid 24 enters the wellbore 14 and is flowed through the annulus with the fluid 18). The swellable material 28 will preferably swell and seal against the drill string 12, thereby preventing flow through the annulus 20.

Figure 4:
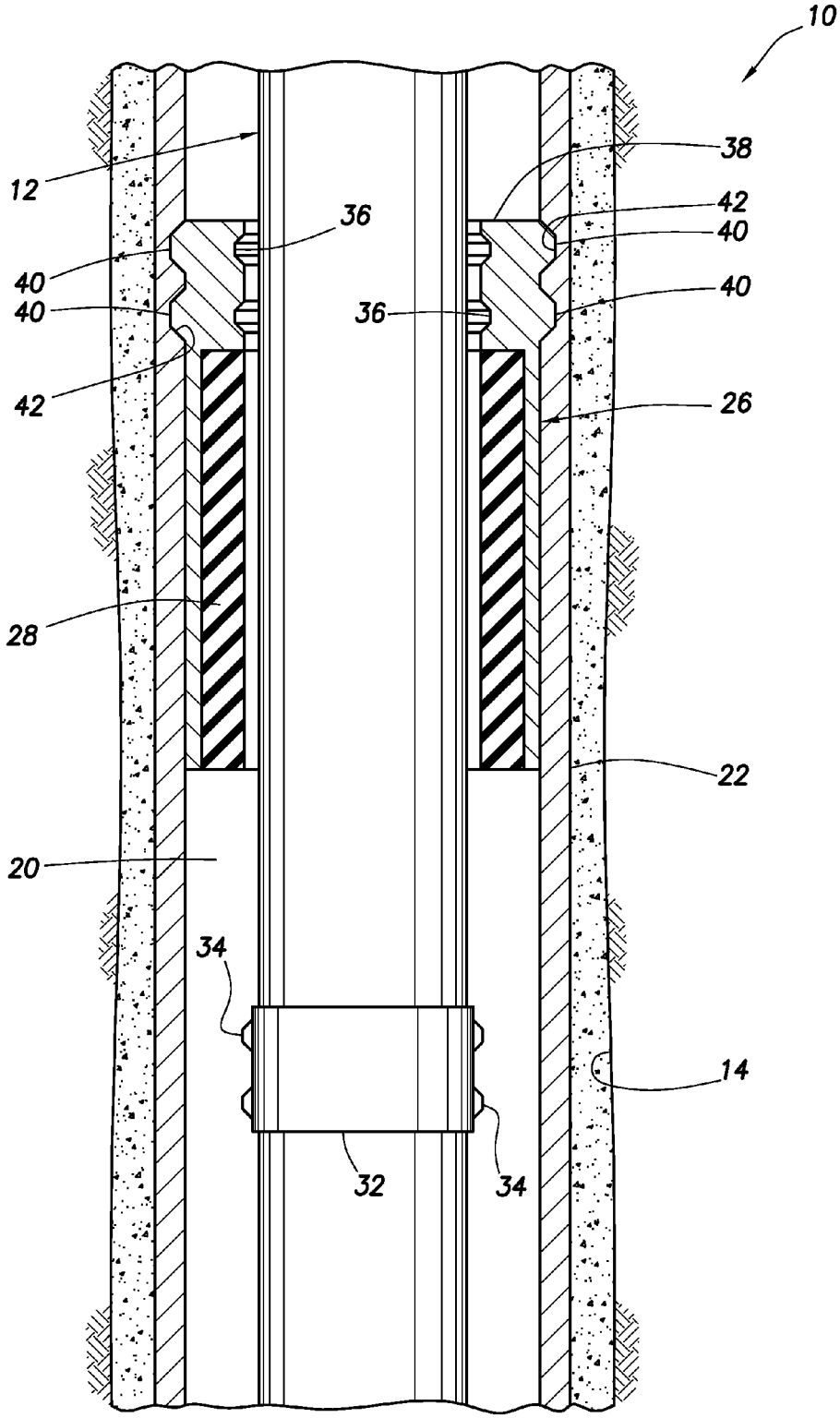
FIG. 4 is an enlarged scale partially cross-sectional view of yet another configuration of the well system.

Referring additionally now to FIG. 4, an enlarged scale cross-sectional view of another configuration of the well system 10 is representatively illustrated. In this configuration, the swellable seal 26 is initially conveyed into the wellbore 14 on the drill string 12, but the seal is then releasably secured to the wellbore lining 22. When the drill string 12 is later retrieved from the wellbore 14, the swellable seal 26 can be retrieved along with the drill string.

In this manner, the swellable seal 26 can be present in the wellbore 14 along with the drill string 12, but the drill bit 16 does not pass through the swellable seal (as in the configuration of FIG. 3), and the swellable seal does not displace with the drill string as the wellbore is being drilled. Instead, the swellable seal 26 can remain in one position as the wellbore 14 is being drilled, and then the swellable seal can be retrieved when the drill string is retrieved from the wellbore.

The drill string 12 in this configuration includes a running tool 32 with latch members 34 (such as dogs, lugs, collets, etc.) which releasably engage one or more internal profiles 36 in a latch 38 of the swellable seal 26. The latch 38 also includes latch members 40 which releasably engage an internal profile 42 formed in the wellbore lining 22.

The swellable seal 26 is initially secured to the drill string 12 by engagement between the latch members 34 and the profile 36 as the drill string is conveyed into the well. Upon reaching the profile 42 in the wellbore lining 22, the latch members 40 engage the profile 42, thereby securing the swellable seal 26 to the wellbore lining. The latch members 34 are then disengaged from the profile 36, thereby permitting the drill string 12 to be lowered further in the wellbore 14, without the swellable seal 26.

When a predetermined activating agent (such as a hydrocarbon) is present in the annulus 20, the swellable material 28 swells and seals off, or at least reduces flow through, the annulus. This prevents or mitigates undesired release of the hydrocarbon from the well.

As with the other configurations described above, the swellable material 28 can swell in the presence of one or more of hydrocarbons, water, gas or other activating agent. The swellable material 28 may be incorporated into the swellable seal 26 assembly in any manner, including but not limited to spirally or helically wrapping, coating, molding, etc.

It may now be fully appreciated that the present disclosure provides several advancements to the art of preventing undesired discharge of fluid from a well. In the well system 10 described above, the swellable seal 26 conveniently seals off the annulus 20 if a particular activating agent is present in fluid 18 circulated through the annulus, without requiring any intervention, control, signals, etc. from the surface.

The above disclosure provides to the art a well system 10 which can include a drill string 12 having a drill bit 16 at an end thereof. A swellable seal 26 is exposed to fluid 18 in an annulus 20 external to the drill string 12. The swellable seal 26 includes a swellable material 28 which swells in response to the fluid 18 comprising a predetermined activating agent (such as fluid 24).

The swellable seal 26 may prevent flow of the fluid 18 through the annulus 20 in response to the fluid 18 comprising the activating agent.

The swellable seal 26 may be carried on the drill string 12. The swellable seal 26 may rotate with the drill string 12 as the drill bit 16 drills a wellbore 14.

The drill string 12 can comprise a running tool 32 which releasably secures the swellable seal 26 to the drill string 12. The swellable seal 26 can comprise a latch 38 which releasably secures the swellable seal 26 to a wellbore lining 22 which surrounds the drill string 12.

The swellable seal 26 may be secured to a wellbore lining 22.

The activating agent may comprise a hydrocarbon.

Also described by the above disclosure is a method of preventing undesired release of fluid 18 from a wellbore 14. The method can include displacing a drill string 12 through the wellbore 14, thereby drilling the wellbore 14; and installing in the wellbore 14 a swellable seal 26 which, in response to the fluid 18 comprising a predetermined activating agent, reduces flow through an annulus 20 formed radially between the drill string 12 and the wellbore 14.

The installing step may be performed prior to the displacing step.

The swellable seal 26 preferably includes a swellable material 28 which increases in volume in response to contact with the activating agent.

The installing step may include conveying the swellable seal 26 into the wellbore 14 on the drill string 12. The swellable seal 26 may rotate with the drill string 12 during the step of drilling the wellbore 14.

The above disclosure also describes a well system 10 which includes a swellable seal 26 carried into a wellbore 14 on a drill string 12, with the swellable seal 26 including a swellable material 28 which swells in response to a fluid 18 in the wellbore 14 comprising a predetermined activating agent.

The swellable seal 26 may be releasably secured to a wellbore lining 22. The swellable material 28 may seal off an annulus 20 surrounding the drill string 12 in response to contact between the swellable material 28 and the activating agent.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a drill string having a drill bit at an end thereof; and a swellable seal exposed to fluid in an annulus external to the drill string, the swellable seal including a swellable material which swells in response to the fluid comprising a predetermined activating agent, wherein the swellable seal is carried on the drill string, and wherein the swellable seal rotates with the drill string as the drill bit drills a wellbore, whereby the swellable seal seals the annulus, and prevents an uncontrolled release of the predetermined activating agent through the annulus during drilling.

2. A well system, comprising:

a drill string having a drill bit at an end thereof;

the drill string including a running tool; and a swellable seal exposed to fluid in an annulus external to the drill string, the swellable seal including a swellable material which swells in response to the fluid comprising a predetermined activating agent, wherein the swellable seal is carried on the drill string, and wherein the running tool releasably secures the swellable seal to the drill string.

3. A well system, comprising:

a drill string having a drill bit at an end thereof; and a swellable seal exposed to fluid in an annulus external to the drill string, the swellable seal including a swellable material which swells in response to the fluid comprising a predetermined activating agent, wherein the swellable seal is carried on the drill string, and wherein the swellable seal comprises a latch which releasably secures the swellable seal to a wellbore lining which surrounds the drill string.

4. A well system, comprising:

a drill string having a drill bit at an end thereof; and a swellable seal exposed to fluid in an annulus external to the drill string, the swellable seal including a swellable material which swells in response to the fluid comprising a predetermined activating agent, wherein the swellable seal is secured to a wellbore lining, whereby the swellable seal seals the annulus, and prevents an uncontrolled release of the predetermined activating agent through the annulus during drilling.

5. A method of preventing undesired release of fluid from a wellbore, the method comprising:

displacing a drill string through the wellbore, thereby drilling the wellbore;

conveying a swellable seal on the drill string;

rotating the swellable seal with the drill string during the step of drilling the wellbore; and swelling in the wellbore the swellable seal in response to the fluid comprising a predetermined activating agent, thereby sealing the annulus and preventing an uncontrolled release of the predetermined activating agent through an annulus formed radially between the drill string and the wellbore during drilling.

6. A method of preventing undesired release of fluid from a wellbore, the method comprising:

displacing a drill string through the wellbore, thereby drilling the wellbore;

releasably securing a swellable seal to the drill string via a running tool of the drill string;

conveying the swellable seal on the drill string; and installing in the wellbore the swellable seal which, in response to the fluid comprising a predetermined activating agent, reduces flow through an annulus formed radially between the drill string and the wellbore.

7. A method of preventing undesired release of fluid from a wellbore, the method comprising:

displacing a drill string through the wellbore, thereby drilling the wellbore;

conveying a swellable seal on the drill string;

swelling in the wellbore the swellable seal in response to the fluid comprising a predetermined activating agent, thereby reducing flow through an annulus formed radially between the drill string and the wellbore;

releasing the swellable seal from the drill string; and releasably securing the swellable seal to a wellbore lining which surrounds the drill string, whereby the swellable seal does not displace with the drill string as the wellbore is being drilled.

8. A method of preventing undesired release of fluid from a wellbore, the method comprising:

displacing a drill string through the wellbore, thereby drilling the wellbore;

swelling in the wellbore the swellable seal in response to the fluid comprising a predetermined activating agent, thereby reducing flow through an annulus formed radially between the drill string and the wellbore; and securing the swellable seal to a wellbore lining, whereby the swellable seal does not displace with the drill string as the wellbore is being drilled.

9. A well system, comprising:

a swellable seal carried into a wellbore on a drill string;

the swellable seal including a swellable material which swells in response to a fluid in the wellbore comprising a predetermined activating agent; and the swellable seal is released from the drill string and releasably secured to a wellbore lining, whereby the swellable seal does not displace with the drill string as the wellbore is being drilled.

* * * * *